United States Patent [19]

Coale et al.

[11] 4,283,017

[45] Aug. 11, 1981

[54] SELECTIVE FLOTATION OF CUBANITE AND CHALCOPYRITE FROM COPPER/NICKEL MINERALIZED ROCK

[75] Inventors: Robert D. Coale, Hoyt Lakes, Minn.; Keith W. Sarbutt, Lakefield, Canada; Derrick B. Smith, Oceanside, Calif.

[73] Assignee: Amax Inc., Greenwich, Conn.

[21] Appl. No.: 73,413

[22] Filed: Sep. 7, 1979

[51] Int. Cl.[3] ..... B02C 23/18

[52] U.S. Cl. ..... 241/24; 209/167

[58] Field of Search ..... 209/166, 167; 241/20, 241/24

[56] References Cited

U.S. PATENT DOCUMENTS

| | | | |
|---|---|---|---|
| 1,269,157 | 6/1918 | Callow | 209/167 |
| 1,377,189 | 5/1921 | Rosenbach | 209/167 |
| 1,397,703 | 11/1921 | Robbins | 209/167 |
| 1,486,297 | 3/1924 | Pallanch | 209/167 |
| 1,636,974 | 7/1927 | Wiser | 209/167 |
| 1,678,259 | 7/1928 | Martin | 209/167 |
| 2,205,194 | 6/1940 | Green | 209/167 |
| 2,399,845 | 5/1946 | Allen | 209/167 |
| 2,432,456 | 12/1947 | Sproule | 209/167 X |
| 3,067,957 | 12/1962 | Erck | 209/166 X |
| 3,220,551 | 11/1965 | Moyer | 209/167 |
| 3,919,079 | 11/1975 | Weston | 209/166 X |

FOREIGN PATENT DOCUMENTS

| | | | |
|---|---|---|---|
| 692316 | 8/1964 | Canada | 209/166 |
| 48-6363 | 12/1969 | Japan | 209/167 |
| 71/1887 | 3/1971 | South Africa . | |

OTHER PUBLICATIONS

Chem. Abstracts, 73, 1970, p. 140, 47644k.
Eng. & Min. J., vol. 177, pp. 80–83, Apr. 1976.
Trans. Soc. Min. Eng., AIME, vol. 241, pp. 421–431, Dec. 1968.

*Primary Examiner*—Robert Halper
*Attorney, Agent, or Firm*—Donald T. Black; Michael A. Ciomek

[57] ABSTRACT

A process for beneficiating a finely ground ore containing sulfide minerals of copper and nickel by selective flotation to produce a copper concentrate and a copper-nickel concentrate comprises pulping the ore with water to form a slurry, conditioning the slurry with an aqueous solution of $SO_2(H_2SO_3)$ equivalent to from about 2 to about 4.5 pounds of $SO_2$ per ton of dry ore for a time sufficiently long to maximize depression of the nickel minerals while maximizing activation of the copper minerals, wherein the conditioned slurry contains about 30 wt. % to about 35 wt. % solids, adding a collector and a frother to the conditioned slurry, subjecting the conditioned material to a rougher flotation stage to produce a rougher copper concentrate and a rougher tailings, conditioning the rougher tailings with additional collector and with $Ca(OH)_2$ to activate unfloated nickel and copper minerals and subjecting the conditioned rougher tailings to froth flotation to produce a rougher copper-nickel concentrate. After regrinding, the rougher copper concentrate is conditioned with $H_2SO_3$, and subjected to one or more cleaner flotation stages to recover a final concentrate containing at least about 80% of the copper and less than about 5% of the nickel in the feed material.

12 Claims, 1 Drawing Figure

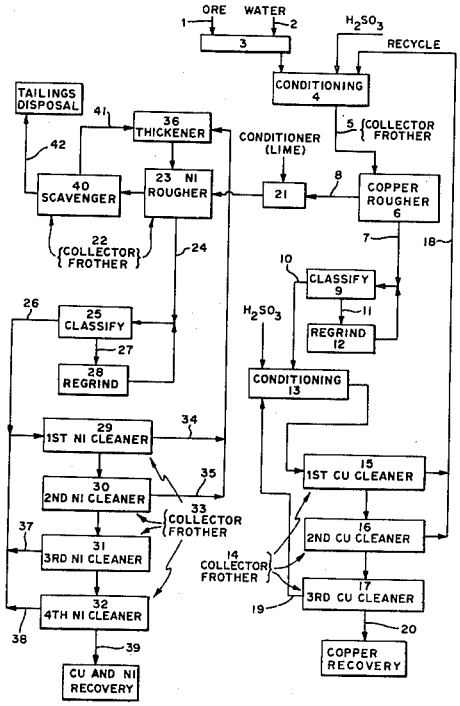

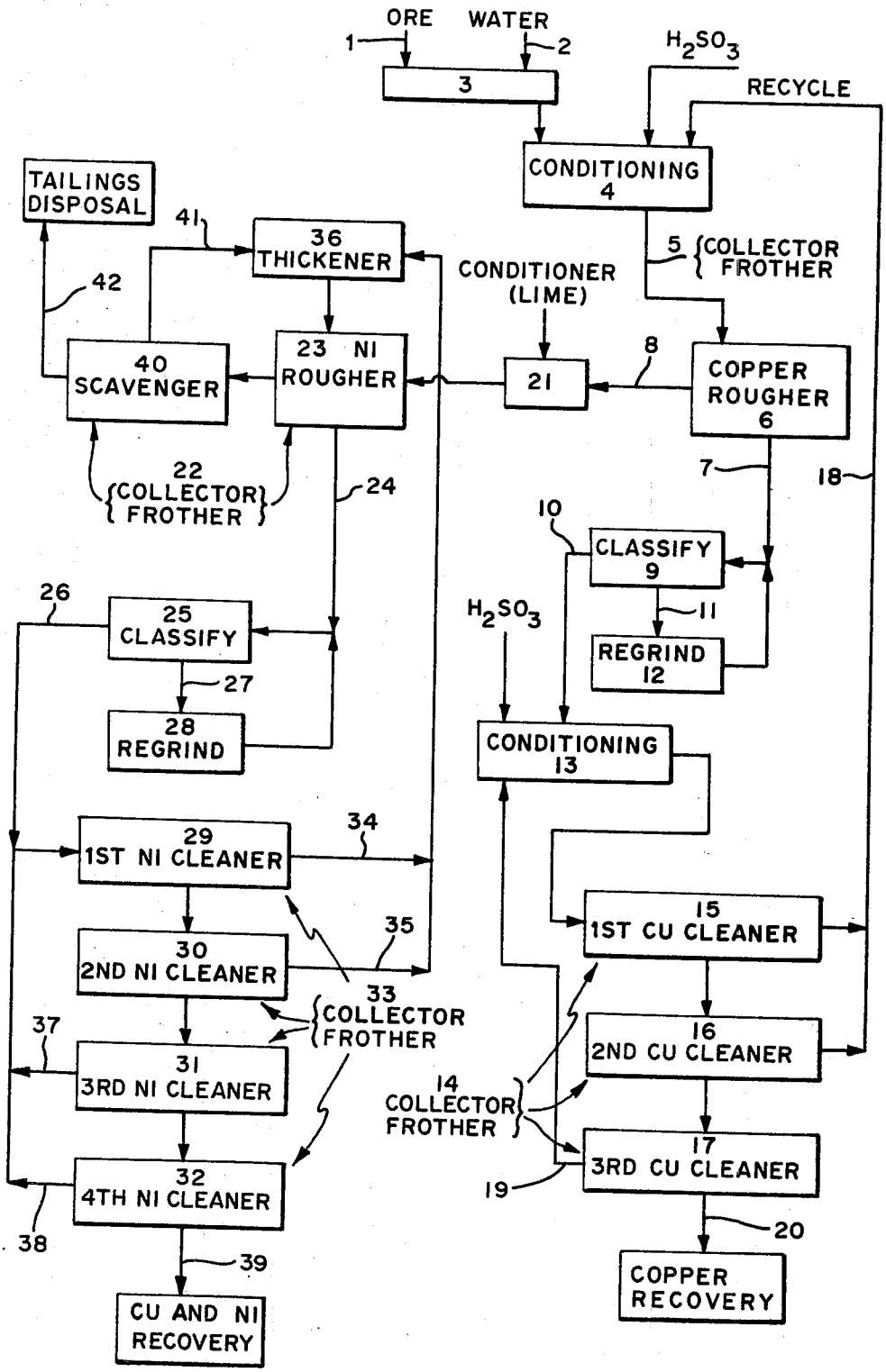
ORE
WATER
1
2
3
$H_2SO_3$
RECYCLE
CONDITIONING 4
TAILINGS DISPOSAL
41
36 THICKENER
5
COLLECTOR FROTHER
CONDITIONER (LIME)
42
40 SCAVENGER
23 NI ROUGHER
21
8
COPPER ROUGHER 6
22 COLLECTOR FROTHER
24
7
18
10
CLASSIFY 9
26
25 CLASSIFY
$H_2SO_3$
11
REGRIND 12
27
28 REGRIND
CONDITIONING 13
29 1ST NI CLEANER
34
15 1ST CU CLEANER
30 2ND NI CLEANER
35
33 COLLECTOR FROTHER
37
31 3RD NI CLEANER
16 2ND CU CLEANER
14 COLLECTOR FROTHER
17 3RD CU CLEANER
32 4TH NI CLEANER
19
38
20
39
COPPER RECOVERY
CU AND NI RECOVERY

SELECTIVE FLOTATION OF CUBANITE AND CHALCOPYRITE FROM COPPER/NICKEL MINERALIZED ROCK

BACKGROUND OF THE INVENTION

1. Field of the Invention

The invention relates to the beneficiation of sulfide ores of copper and nickel. More specifically, it relates to the selective flotation of copper and nickel minerals. A process has been discovered which permits the separate recovery of copper and nickel concentrates from such ores. Thus, the invention is useful where it is sought to process nickel- and copper-containing ore to recover separately a copper concentrate and a nickel concentrate.

The invention is particularly useful, for instance, in beneficiating ore that is found in the copper-nickel mineralization of the Duluth Complex orebody in northeastern Minnesota. This copper-nickel ore has resisted previous attempts to design a flotation process to recover a copper concentrate low in nickel.

2. Description of the Prior Art

A brief discussion of the Duluth Complex copper-nickel mineralization appears in *Engineering & Mining Journal,* Vol. 177, April 1976, at pages 80–83, together with a flowsheet for bulk treatment of the ore to achieve a rough separation of the copper and nickel minerals from gangue material. The discussion of the flowsheet does not suggest the selective flotation of the copper and nickel minerals using the sulfurous acid conditioning stage of the process in accordance with the present invention. Treatment of ore samples with the process from the disclosed flowsheet (with one rougher flotation stage and three cleaner flotation stages) produced bulk concentrates having copper contents of about 12%, corresponding to copper recoveries on the order of 85%, and nickel contents of about 2.5%, corresponding to nickel recoveries of about 68%.

The Duluth gabbro is also discussed in *Transactions, Soc. of Mining Engineers, AIME,* Vol. 241, December, 1968, at pages 421–431. This article discloses a flowsheet for bulk sulfide flotation followed by separation of copper minerals from nickel minerals, using traditional conditioning agents such as lime/cyanide and lime/-British gum. In some runs the pH is optionally adjusted to about 6 with sulfuric acid. There is no disclosure or suggestion of conditioning the ore in aqueous sulfurous acid, as is evident from the results reported which show only mediocre recovery of copper in the final copper concentrate.

There are earlier processes in which mixtures of sulfidic copper and iron minerals are conditioned prior to flotation with sulfite derivatives, to promote the copper sulfides and depress the iron sulfides. Specifically, U.S. Pat. No. 1,397,703 discloses using a "non-alkaline electrolyte", such as a solution of sodium sulfite, and U.S. Pat. No. 1,678,259 discloses using an acid sulfite or sulfurous acid. Neither patent discloses whether nickel minerals were possibly included with the minerals under treatment, and the patents thus do not indicate or suggest the effect, if any, of the disclosed processes on nickel minerals. In addition, the statement on page 2, lines 41–44 of U.S. Pat. No. 1,678,259 that solutions of sulfur dioxide in water (i.e. sulfurous acid) are unstable and difficult to handle suggests to one skilled in this art not to include a sulfurous acid conditioning step in a continuous process for the separation of nickel sulfide minerals from mixtures with copper sulfide minerals.

Published South African Patent Application No. 71/1887, filed Mar. 23, 1971, relates to the froth flotation of copper sulfide minerals from ore that also contains carbonates, such as $Ca(Mg)CO_3$, and magnetite, $Fe_3O_4$. The application discloses that sulfurous acid added to the copper flotation circuit underflow, which is rich in the carbonate minerals and contains minor residual amounts of unfloated copper sulfide minerals, reacts with the carbonates to form bisulfite compounds such as $Ca(Mg)(HSO_3)_2$ which activate the residual copper sulfides for recovery in a subsequent flotation stage. The sulfurous acid can also lead to precipitation of calcium and magnesium compounds. There is no disclosure of what, if any, nickel minerals are present in the ore under treatment or in the underflow which is treated with the sulfurous aicd, and thus there is no suggestion of the presently claimed discovery that conditioning a pulped copper-nickel ore in sulfurous acid can selectively activate the copper minerals and depress the nickel minerals. In addition, the Duluth gabbro orebody with which the present invention has been found to be effective does not contain the large amounts of carbonate minerals present in the ore discussed in the South African application; indeed, the Duluth gabbro contains no carbonates, or no more than trace amounts which do not affect the activation of the copper minerals by the sulfurous acid, and the South African application does not suggest that sulfurous acid is an effective conditioning medium for ores that are substantially free from carbonates.

SUMMARY OF THE INVENTION

Stated generally, the invention comprises a process for selectively recovering a copper concentrate and a copper-nickel concentrate from finely ground ore containing sulfide minerals of copper and nickel and substantially free from carbonate minerals which comprises pulping the ore with water to provide a slurry, adding sulfurous acid to the slurry in an amount equivalent to between about 2 pounds and about 4.5 pounds of sulfur dioxide per ton of dry ore, wherein the slurry after the addition of the sulfurous acid has a solids content between about 25% and about 35% by weight, conditioning the slurry with the sulfurous acid sufficiently long to maximize depression of the nickel sulfide minerals while maximizing activation of the copper sulfide minerals, adding a collector and a frother to the conditioned slurry, subjecting the conditioned slurry to froth flotation to produce a froth containing a copper rougher concentrate and an underflow copper rougher tailing, conditioning the copper rougher tailing to activate unfloated copper and nickel minerals, adding additional frother and collector to the copper rougher tailing, and then subjecting the copper rougher tailing to froth flotation to produce a froth containing a copper-nickel rougher concentrate.

BRIEF DESCRIPTION OF THE DRAWINGS

FIG. 1 is a block-diagram representation of a flowsheet embodying the process of the present invention.

DETAILED DESCRIPTION OF THE INVENTION

With reference to FIG. 1, finely ground ore 1 including nickel and copper sulfides is slurried with water 2 at 3, and the slurry is conditioned at 4 in aqueous sulfurous acid under conditions to be described below in greater detail. Appropriate amounts 5 of collector and frother are added, and the conditioned slurry is subjected to a copper rougher flotation stage 6 which produces a froth 7 containing a rougher copper concentrate, and an underflow stream 8. The rougher concentrate is classified at 9 to recover a stream 10 of finely divided material, and a stream 11 of oversize material which is reground at 12 and then recycled to the classifier 9. The resultant stream 10 is conditioned at 13 with additional sulfurous acid, and subjected to cleaner froth flotation stages with additions 14 as necessary of collector and frother. Two to four cleaning stages will normally be used, and three stages have been found preferable and are shown in FIG. 1 at 15–17. Underflow from the first two cleaner stages is recycled in stream 18 to conditioning stage 3. Underflow stream 19 from the third cleaning stage 17 is recycled to conditioning stage 13. The froth 20 from third cleaning stage 17 is processed for recovery of metallic copper.

Underflow stream 8 from copper rougher stage 6 is conditioned at 21 with lime, appropriate amounts 22 of collector and frother are added, and the stream is subjected to a copper-nickel rougher froth flotation stage 23. This stage produces a froth 24, containing nickel and copper values, which is classified at 25 to produce a stream 26 of finely divided copper-nickel concentrate and a stream 27 of oversize material which is reground at 28 and then reclassified. The stream 26 is subjected to several cleaner flotation stages, preferably four in number as shown in FIG. 1 at 29–32. Additions 33 as needed of collector and frother are made to the copper-nickel cleaner stages. The underflow streams 34 and 35 from copper-nickel cleaner stages 29 and 30, respectively, are recycled to thickener 36 and the thickened stream is fed to nickel rougher 23. Underflow streams 37 and 38 from, respectively, third and fourth copper-nickel cleaning stages 31 and 32 are recycled to the feed to first cleaner stage 29. The froth 39 from the final copper-nickel cleaning stage is processed for recovery of metallic copper and nickel.

The copper-nickel rougher stage 23 also produces an underflow stream which is subjected to a scavenger flotation stage 40, producing a froth 41 which is thickened in thickener 34 and recycled to the copper-nickel rougher stage 23, and a tailings stream 42 which is disposed of.

The treatment of copper-nickel ore by selective flotation, including the sulfurous acid conditioning step described herein, has been found to be preferable to bulk flotation of such ore because the concentrates obtained through selective flotation are more amenable for proven subsequent smelting and refining techniques to produce pure metallic copper and nickel.

The term "flotation" used herein will be understood to mean froth flotation.

As indicated, the present invention is adapted to beneficiating ores containing sulfidic copper and nickel minerals, such as minerals of the type found in the Duluth Complex. The Duluth Complex orebody is a well-defined mineral zone in northeastern Minnesota.

Feed material which may be beneficiated by the present invention possesses several characteristics which are believed to avoid the inefficacy of prior art techniques for separating the copper and nickel mineral values. Copper is present as cubanite (nominally, $Cu_2S.Fe_4S_5$) and chalcopyrite (nominally, $CuFeS_2$). Nickel is present as fine inclusions of pentlandite ((Ni,Fe)S) in pyrrhotite and in the host rock. The inclusions of pentlandite are so fine that some of the pentlandite may not be liberated from the pyrrhotite and the host rock even when the feed material is ground to the smallest sizes that could normally be treated by froth flotation. The pyrrhotite has a nominal composition of $Fe_nS_{(n+1)}$, wherein n is between about 5 and about 16. The copper grade is typically from about 0.25% to about 3%; the nickel grade is typically from about 0.07% to about 0.55%. The present invention may advantageously be practiced to achieve high selectivity between copper and nickel in ores that are free from carbonate mineralization.

Initially, in carrying out the invention the mineral-bearing material should be crushed and ground to a particle size sufficient to liberate most of the sulfide minerals from the host rock. Typically, the material should be brought to a size range of at least about 50% minus 200 mesh Tyler Screen Size (TSS). Reduction in particle size can be achieved through means quite familiar to those skilled in this art, e.g. staged crushing and grinding, and should be carried out to a degree which maximizes sulfide mineral liberation while minimizing sliming.

The ground ore is then pulped with sufficient water to provide a slurry, containing from about 25% up to about 35% solids by weight, and preferably between about 30% and about 35% solids by weight, in order to minimize materials handling while maximizing sulfide mineral recovery.

The slurried ore is then subjected to a conditioning step which constitutes one novel and important feature of the invention. The conditioning medium is an aqueous solution formed by dissolving sulfur dioxide in water, forming sulfurous acid ($H_2SO_3$). It has been found that when sulfurous acid is added to the slurry to provide a selected ratio of sulfur dioxide to dry feed material, the copper minerals (cubanite and chalcopyrite) are promoted and the nickel minerals and gangue are suitably depressed to permit recovery in subsequent treatment stages of a product that represents a surprisingly high recovery of copper values and a surprisingly low retention of nickel values. This discovery permits the treatment of the copper-nickel ore to recover a concentrate having a surprisingly high copper:nickel ratio, together with a copper-nickel concentrate having similar amounts of copper and nickel.

Conditioning the pulped ore in accordance with the present invention achieves superior copper recovery and nickel rejection compared to other conditioning steps, including those which involve adding sulfuric acid to a mineral pulp or which involve the bubbling or sparging of gaseous sulfur dioxide directly into a mineral pulp.

The effectiveness of the conditioning step in achieving a high degree of separation between copper and nickel minerals is particularly unexpected because one skilled in this art would expect the sulfurous acid to promote the nickel sulfide-containing minerals together with the copper sulfide-containing minerals. To the contrary, though, it has been found that this conditioning step results in promotion of the copper sulfides and rejection of the nickel sulfidic material in subsequent flotation stages. This effect is observed throughout the range of particle sizes to which the feed material is reduced before it is subjected to flotation.

The effectiveness of this conditioning step is also unexpected because it allows recovery of a concentrate having very satisfactory copper content, with relatively low nickel retention, as mentioned above, without requiring introduction of lime, cyanide, or other conditioning agents to the flotation circuit. Omitting these other conditioning agents offers relief from both the additional costs and the environmental and safety risks that these agents present. As will be seen below, the invention including the sulfurous acid conditioning step possesses the additional feature that it utilizes smaller amounts of collector in the rougher and cleaner flotation stages than would customarily be expected. This feature presents additional economical advantages in operation.

The pulped ore solids are placed in a conditioning tank. The sulfurous acid solution is then added to the pulp at a ratio which should correspond to from about 2 to about 4.5 pounds of sulfur dioxide per ton of dry feed material. A preferred ratio is from about 2 to about 3.5 pounds of sulfur dioxide per ton of dry feed. Examples of particular ratios of $SO_2$ to feed material are given below. The slurry after addition of the sulfurous acid should have a pulp density between about 30% and about 35% solids by weight, and preferably between about 33% and about 35% solids, to permit satisfactory conditioning of the pulp and be amenable to the subsequent rougher and cleaner flotation stages. The density can be adjusted by suitable additions of water or feed material to a satisfactory value which one skilled in the art can readily ascertain.

Conditioning is achieved by agitating the pulp in a tank equipped with suitable agitator, such as motor-driven impeller, to provide good solid-liquid contact between the finely divided ore and the sulfurous acid. The pulp is conditioned sufficiently long to maximize depression of the nickel minerals while maximizing activation of the copper minerals. Conditioning time will vary from ore to ore but it has been found that for the ores tested conditioning times between about 5 minutes and about 10 minutes, preferably about 6 to about 8 minutes, will provide maximum depression of the nickel minerals. The pH of the conditioned slurry should be between about 5 and about 6.5, and preferably between about 5.5 and about 6.

It is important to minimize aeration of the pulp during conditioning. Excess air will cause unwanted oxidation of the mineral surfaces, destroying the selectivity between copper and nickel minerals that is afforded by conditioning the ore in sulfurous acid.

Following the conditioning, the pulp is subjected to a copper rougher flotation stage, to recover most of the copper values in the froth (concentrate) while rejecting significant quantities of nickel and iron values and gangue in the underflow. A collector and a frother are added to the conditioned pulp for this flotation. The particular compounds to be used as collector and frother can be readily selected by one familiar with the flotation separation of copper from nickel minerals. In general, dithiophosphate collectors may be used, such as sodium dithiophosphate, or proprietary dithiophosphates such as Reagent R-208, sold by American Cyanamid Co. Another suitable collector is Reagent Z-200, sold by Dow Chemical Co., which has a proprietary formula but is known not to be a dithiophosphate. Examples of suitable frothers include methyl isobutyl carbinol (MIBC), triethoxy-butane (TEB), and cresylic acid.

Satisfactory separation between copper and nickel minerals can be achieved in the copper rougher stage when the amount of collector used is between about 0.01 and about 0.1 pound per ton of dry ore fed. The amount of collector used is important in that amounts higher than this range can carry too much nickel into the concentrate and impair the separation. The preferred range of collector additions is between about 0.040 and about 0.055 pounds per ton of dry ore. The collector is added to the conditioned pulp prior to flotation.

The amount of frother added to the pulp for the copper rougher flotation is dependent on the desired froth characteristics, and can be selected with ease by one skilled in this art. A typical range of frother addition is about 0.04 to about 0.1 pound of MIBC per ton of dry ore. Incorporation of the conditioning stage in accordance with the present invention in place of other conditioning methods improves froth characteristics.

The recoveries and separation in the copper rougher flotation are also sensitive to the length of time for which the flotation is carried out. Too short a run lowers the copper recovery, while too long a run can bring excessive nickel and iron minerals into the copper rougher concentrate. Rougher flotation times required to provide the selective flotation of the copper minerals from the nickel minerals are dependent upon the nature of the ore being treated, but rougher flotation times between about 5 minutes and 30 minutes generally provide acceptable levels of selectivity. Preferred flotation times are in the range of about 12 to about 18 minutes; one skilled in this art can readily determine the length of time needed to achieve a particular recovery from a given quantity of feed material.

If a mineral pulp of the type described previously is subjected to conditioning and rougher flotation under the conditions given herein, the copper rougher concentrate produced will have a copper content of at least about 7%, and a copper recovery of at least about 80% to about 95%. Preferably, the copper content of the rougher concentrate will be at least about 8.5%, and the recovery will fall above about 85%, and more preferably at least about 90%.

At the same time, the nickel content of the copper rougher concentrate will be typically less than about 1%, and represent a nickel retention of less than about 40% and typically under about 30%. It is preferred that the nickel content be under about 0.50%, and that the nickel content represent a retention of less than about 30%.

The copper and nickel contents of the froth and underflow streams from the copper rougher will, of course, depend on the grade of the feed ore. For a feed grade assaying 0.53% Cu and 0.13% Ni, for instance, the copper rougher flotation stage produces an underflow stream which has a nickel content of at least about 0.10%, and preferably at least about 0.12%. The copper content is between about 0.09% and about 0.12%, and advantageously is between about 0.10% and about 0.11%. The corresponding rejection of nickel to the underflow from the copper rougher stage is at least about 60%, and preferably at least about 70%. The copper rejection, i.e. the copper values that are not carried into the froth of the copper rougher, should be from about 5% to about 20%, and advantageously are between about 10% and about 15%. Typically, about 8% to about 25% of the solids fed to the copper rougher leave it in the froth, while about 75% to about 92% are carried in the underflow. The subsequent treatment of the underflow stream will be discussed below.

The copper rougher concentrate should be processed further, to improve the copper grade and reduce the nickel content of the concentrate. Several cleaner flotation stages can be employed to improve the copper grade to a very satisfactory level without unduly reducing the overall copper recovery of the system, while rejecting additional amounts of nickel.

The copper rougher concentrate should first be treated to reduce the particle size to at least about 50%, and preferably at least about 85%, minus 400 mesh TSS. Although the entire copper rougher concentrate can be comminuted to the required particle size, the overall efficiency of the cleaning operation is enhanced by classifying the copper rougher concentrate and comminuting only the oversized material to the requisite particle size. The copper rougher concentrate can be classified by well-known means, such as hydrocyclones. The particles larger than desired are reground to the proper size, and are recombined with the remaining fraction. The copper rougher concentrate is then fed to a second sulfurous acid cleaner conditioning stage.

This conditioning step is similar to the conditioning step that precedes the rougher flotation. A pulp is formed by adding the copper rougher concentrate to an aqueous solution of sulfur dioxide (i.e. $H_2SO_3$), at a ratio equivalent to about 1 pound of sulfur dioxide per ton of dry feed material introduced to the rougher circuit. The density of this pulp is adjusted to between about 10% and 25% solids by weight, preferably between about 18% and about 24% solids by weight, and the pulp is preferably conditioned for about 3 up to about 10 minutes, preferably about 8 to about 10 minutes.

The conditioned pulp, containing the copper rougher concentrate and recycled tailings from subsequent cleaning steps as described below, is then subjected to copper cleaner flotation stages. As is the case for the copper rougher flotation, the amounts of frother and collector added to the pulp, and the duration of the cleaner flotation stage, are determined with a view to the degree of separation required or desired, and these factors are readily identified by one skilled in this art. One may find that additions of collector and/or frother are not necessary, if sufficient quantities of the reagents have been carried along with the concentrate from the preceding copper rougher flotation. Thus, the appropriate amounts to add to the first copper cleaner stage are 0 to about 0.005 pounds of collector, and 0 to about 0.025 pounds of frother, per ton of new dry copper rougher circuit feed. The duration of the first copper cleaner flotation is about 10 to about 12 minutes. The pH is between about 5 and about 6.5, and preferably about 5.4 to about 5.7.

The concentrate produced in the first copper cleaner flotation stage typically has a copper content of at least about 13%. The corresponding copper recovery from the cleaner feed (including recycled tails) is at about 60%. The cleaner concentrate also contains nickel, but the nickel content has been reduced to below about 1%, and preferably less than about 0.5%. This corresponds to a nickel rejection of about 75%, based on the feed to the rougher circuit. The tailings from the first copper cleaner flotation are recycled to the conditioning step that precedes the copper rougher flotation.

The concentrate from the first copper cleaner flotation is subjected to one and, more preferably, two additional copper cleaner flotation stages. In each, the requirements for collector and frother can be readily determined; also, the length of time during which the flotation is carried out to obtain a highly satisfactory copper content and recovery can be identified without great effort. Of course, the concentrate from the second copper cleaner flotation is fed to the third copper cleaner flotation stage. The tailings from the second copper cleaner should be recycled to the conditioning stage which precedes the copper rougher flotation stage. The tailings from the third copper cleaner may be recycled to the feed to the first copper cleaner flotation stage.

From 0 to about 0.014 pounds of collector, and 0 to about 0.065 pounds of frother, per ton of new dry copper rougher feed, should be added to the second copper cleaner stage, and flotation should last from about 9 to 11 minutes. In the third copper cleaner stage reagent additions are generally not required, but, if needed, additions will be of the same order of magnitude as additions to the second cleaner. Flotation in the third cleaner is carried out for between about 8 and about 10 minutes. The pH in the second copper cleaner stage should be between about 5 and about 6.6, preferably about 5.6 to about 5.8, and the pH in the third copper cleaner stage should be about 5.5 to about 7.0.

In the concentrate from the third copper cleaner stage, the overall copper recovery from the new rougher feed is typically at least about 75%, preferably above about 80%, and can exceed about 85%. In this product, the nickel rejection is typically at least about 90%, and can be over about 95%.

The content of copper and nickel in the second copper concentrate is typically about 15% to about 19% copper, and from about 0.45% to about 0.3% nickel, preferably from about 0.35% to about 0.34%. Typical copper content of the third copper cleaner concentrate will be from about 17% to about 25%. The nickel content of the third copper cleaner concentrate will be about 0.8% or under, typically less than about 0.32% to under about 0.25%. Recovery of the metals into this concentrate is about 75–85% of the copper present in the crude ore and about 3% to about 6% of the nickel present in the crude ore.

The product, concentrated in copper, which results from the copper cleaner stages is suitable for treatment by known methods to recover metallic copper.

The underflow stream from the copper rougher flotation stage is also conditioned and subjected to additional flotation stages, to produce a copper-nickel concentrate from which metallic copper and nickel may be refined by known methods. As indicated above, it is desirable that most of the copper contained in the ground ore be recovered in the copper rougher froth, but copper values remaining in the underflow from the copper rougher can be concentrated and recovered.

The underflow stream is first fed to a conditioning stage, in which a conditioner such as lime is added to activate the nickel values in the stream. Optionally, copper sulfate ($CuSO_4$) may be added. This conditioning activates the remaining copper minerals as well as the nickel minerals. The conditioning raises the pH of the stream to between about 8 and about 9, preferably between about 8.2 and about 8.4. Conditioning may be carried out by adding the conditioning agent to the underflow stream in a tank under agitation by e.g. an impeller, to afford good solid-liquid contact. Agitation should be maintained for sufficiently long to maximize activation of the nickel minerals, preferably for about 2 to about 4 minutes.

The conditioned stream, which has a solids content of about 30% to about 35% solids by weight, is then subjected to a copper-nickel rougher flotation stage, to recover most of the metal values in the stream. Most of the copper values that were not recovered in the froth in the copper rougher stage will also report to the copper-nickel rougher froth. A collector and a frother should be added to the conditioned stream prior to the copper-nickel rougher flotation. Compounds that can be used as collector and as frother, and the appropriate amounts thereof to use, can be readily determined by those skilled in the art. For instance, suitable collectors include higher xanthathes, e.g. potassium amyl xanthate and suitable frothers include MIBC, triethoxybutane (TEB), and cresylic acid. Between about 0.01 and about 0.07 pounds of collector, and between about 0.04 and about 0.11 pounds of frother, per ton of new dry solids fed to the copper rougher, should be used.

Flotation should be carried out long enough so as to maximize recovery of the metal values; the flotation time will depend on the nature of the minerals in the stream being treated, but times between about 14 and about 16 minutes will generally provide satisfactory recoveries.

The copper-nickel rougher flotation carried out under the foregoing conditions should produce a froth having a nickel content of at least about 1.4%, and preferably higher, i.e. above about 2.5%. The nickel recovery, based on the ground ore fed to the copper rougher stage, is at least about 65% and preferably at least about 75%. The copper content of the froth will be about 1.5%. The corresponding copper recovery in the copper-nickel rougher froth is less than about 20%, preferably about 10%.

The underflow from the copper-nickel rougher flotation is subjected to a scavenger flotation, employing about 0.04 to about 0.07 pounds of collector and about 0.005 to about 0.010 pounds of frother per ton of solids fed to the copper rougher circuit. Suitable collector and frother compounds are the same as those usable in the copper-nickel rougher stage. The scavenger froth typically contains about 0.5% to about 1.0% nickel, and about 0.5% to about 1.0% copper. Relatively long retention times are required for the copper-nickel rougher and scavenger flotation stages, e.g. times on the order of about 15 and 25 minutes, respectively. The scavenger froth is thickened and recycled to the nickel rougher. The scavenger underflow, typically containing less than about 0.04% nickel and less than about 0.04% copper, is disposed of as tailings.

The froth from the copper-nickel rougher and scavenger stages should be processed further, to improve the grade of the nickel concentrate. The froth should first be reground to a particle size such that at least about 85% is minus 400 TSS. The froth is advantageously classified so that only oversize particles are reground; the classification is carried out in equipment such as a hydrocyclone.

There follow several, preferably four, nickel cleaning flotation stages. Appropriate amounts of collector and frother are added, as needed; appropriate reagents are those identified above for use in the copper-nickel rougher. The amounts, as needed, can be readily determined by one skilled in this art.

Advantageously, the underflow streams from the first two cleaner stages are thickened and recycled to the nickel rougher, and the underflow streams from the subsequent cleaner stages are recycled to the feed to the first copper-nickel cleaner.

The concentrate produced by the last copper-nickel cleaner stage typically contains at least about 4% nickel, and preferably at least about 5.5%. The nickel recovery based on the nickel fed to the copper rougher corresponds to at least about 60%, and preferably at least about 70%. The copper content of the final copper-nickel cleaner concentrate is between about 3% and about 6%, with a recovery of about 10% to about 20% of the copper fed to the copper rougher.

The concentrate produced by the copper-nickel cleaner stages can be treated by known methods to recover metallic nickel and copper.

The improved selectivity that can be obtained between the copper and nickel minerals of the orebody under investigation by conditioning the pulped ore in sulfurous acid in accordance with the present invention can be demonstrated by comparison to ore treatment techniques employing other approaches to conditioning the ore. Accordingly, the following Examples 1–3 report the results obtained by subjecting the pulped ore to copper rougher flotation without conditioning of the ore (Example 1), with conditioning of the pulped ore by sparging gaseous sulfur dioxide into the pulp (Example 2), and with conditioning of the pulped ore by adding an aqueous solution of sulfuric acid ($H_2SO_4$) (Example 3).

In all the following Examples 1–8, amounts of reagents added are expressed as pounds "per ton of dry ore fed", by which is meant pounds per ton of fresh dry ore which is ground, slurried, and fed to the copper rougher circuit. All of the tests reported herein except Example 3 were performed in a continuously operated pilot plant at a nominal feed rate of 1000 pounds/hour, in which the first and second copper cleaner underflows were recycled to the conditioning stage upstream from the copper rougher. Example 3 was performed in the laboratory.

EXAMPLE 1

Ore assaying 0.74% Cu and 0.17% Ni was ground to 51.8% minus 200 mesh TSS, and then slurried in water to 43% solids by weight. The pH of the slurry was 8.7.

The slurry was prepared for the copper rougher flotation by adding to it collector, Cyanamid R-208, at 0.045 pounds per ton of dry ore fed and frother, MIBC, at 0.099 pounds per ton of dry ore fed. This mixture was subjected to froth flotation for about 15 minutes. A froth was obtained which contained 7.5 wt.% solids, comprising 8.4% Cu and 1.5% Ni. The corresponding recoveries in the froth were 85% Cu and 69% Ni.

EXAMPLE 2

Ore assaying 0.83% Cu and 0.18% was ground to 62.2% minus 200 mesh TSS and then slurried with water to 33% solids by weight. Sulfur dioxide ($SO_2$) was bubbled through a submerged pipe into the ore slurry at a rate of 3.5 pounds of $SO_2$ per ton of dry ore fed. The pH was 6.3. The slurry was agitated, during and following addition of the $SO_2$, for 10 minutes; agitation was carried out in a manner which minimized aeration of the ore.

Flotation reagents were then added to the conditioned slurry, at rates of 0.037 pounds of Cyanamid R-208 (collector) and 0.062 pounds of MIBC (frother) per ton of dry ore fed. This mixture was subjected to froth flotation for about 14 minutes. A froth was obtained containing 8.9% solids by weight, and having a Cu content of 8.2% and a Ni content of 1.1%. The corresponding recoveries in the froth were 88% Cu and 55% Ni.

EXAMPLE 3

Ore assaying 0.80% Cu and 0.17% Ni was ground to about 65% minus 200 mesh TSS, and then slurried with water to about 30% by weight. Sulfuric acid ($H_2SO_4$) at the rate of 6.36 pounds of acid per ton of ore was added to the ore slurry. The pH was 5.4. The acid-ore slurry was agitated for 10 minutes.

The thus conditioned pulp was prepared for copper rougher flotation by adding to it 0.030 pounds of Cyanamid R-208 (collector) per ton of dry ore fed, and 0.024 pounds of MIBC (frother) per ton of dry ore fed. This mixture was then subjected to froth flotation for 8 minutes. A froth was obtained having a solids content of 9.76 wt.% and having a Cu content of 7.8% and a Ni content of 1.33%. The corresponding recoveries in the froth were 96% Cu and 76% Ni.

By contrast with Examples 1–3, it can be shown that conditioning a pulped ore with sulfurous acid in accordance with the foregoing description leads to much better selectivity between copper and nickel minerals in the copper rougher flotation stage. This selectivity in turn improves the copper-to-nickel ratio of the concentrates produced in the copper cleaning stages. Thus, the invention is described and illustrated in the following non-limiting Examples 4–8.

EXAMPLE 4

Ore assaying 0.91% Cu and 0.20% Ni was ground to 57% minus 200 mesh TSS. The ground ore was slurried with water to 33% solids by weight. An aqueous solution of 2.2 wt.% $H_2SO_3$ was prepared continuously by dissolving sulfur dioxide in water, and this solution was added to the slurried ore to from a pulp having a ratio of acid to ore equivalent to 3.5 pounds of sulfur dioxide per ton of dry ore fed to the circuit. The pulp density was 33 wt.% solids. The pH was 6.0. The pulp was agitated for about 8 minutes.

The conditioned pulp was prepared for the copper rougher flotation by adding to it, per ton of dry ore fed, 0.044 pounds of American Cyanamid Co. Reagent R-208 (a dithiophosphate collector) and 0.078 pounds of MIBC (frother). This mixture was subjected to copper rougher flotation for 14 minutes. A froth was obtained containing 10.8 wt.% solids, and an underflow stream was obtained containing 89.2 wt.% solids. The grades and recoveries of copper and nickel in the two product streams are given below in Table 1.

The copper rougher concentrate was classified and reground so that 90% was minus 400 mesh TSS. This reground concentrate was not subjected to further conditioning in $H_2SO_3$. The reground concentrate, as a pulp which contained 10% solids by weight, was agitated for 3 minutes. It was then subjected to a first copper cleaner flotation stage, using no additional collector and 0.023 pounds of MIBC (frother) per ton of dry ore fed. Flotation lasted for 10 minutes at a pH of 6.2. The resultant cleaner concentrate was subjected to second and third copper cleaner flotation stages, during which no additional collector and frother were required. Second cleaner flotation lasted for 10 minutes, at a pH of 6.6. Third cleaner flotation lasted for 8 minutes, at a pH of 7.1. Underflows from the first and second cleaner stages were recycled to the first conditioning stage (upstream from the copper rougher), and the underflow from the third copper cleaner was recycled to the feed to the first copper cleaner.

The copper and nickel contents and recoveries in the concentrates from the copper cleaner flotation stages are given in Table 1.

Table 2 shows the solids content, and copper and nickel recovery data, for the underflow stream from the copper rougher flotation. 1.97 pounds of lime per ton of dry ore fed was added to the underflow stream to activate the nickel and residual copper, raising the pH of the stream to 7.9. The stream, containing the conditioner, was agitated for about 3 minutes. Then 0.049 pounds of sodium isopropyl xanthate (collector) and 0.059 pounds of MIBC (frother) (each, per ton of dry ore fed) were added to the conditioned stream, and the stream was subjected to a copper-nickel rougher flotation for about 30 minutes. The copper-nickel rougher concentrate was reground to about 85 wt.% minus 400 mesh TSS, and then subjected to three stages of cleaning. Underflows from the copper cleaning stages were recycled to the copper first cleaner.

The solids content, copper and nickel contents, and copper and nickel recoveries from the copper-nickel cleaning circuit are given in Table 2.

EXAMPLE 5

Ore assaying 0.73% Cu and 0.16% Ni was ground to 60% minus 200 mesh TSS. The ground ore was slurried with water to 27% solids by weight. An aqueous solution of 2.2 wt.% $H_2SO_3$ was prepared continuously by dissolving sulfur dioxide in water, and this solution was added to the slurried ore to form a pulp having a ratio of acid to ore equivalent to 3.5 pounds of sulfur dioxide per ton of ore. Th pulp density was 27 wt.% solids. The pH was 5.7. The pulp was agitated for about 8 minutes.

The conditioned pulp was prepared for the copper rougher flotation by adding to it, per ton of dry ore fed, 0.046 pounds of American Cyanamid Co. Reagent R-208 (collector) and 0.083 pounds of MIBC (frother). This mixture was subjected to copper rougher flotation for 14 minutes. A froth was obtained containing 8.5 wt.% solids, and an underflow stream was obtained containing 91.5 wt.% solids. The grades and recoveries of copper and nickel in the two product streams are given below in Table 1.

The copper rougher concentrate was classified and reground so that 90% was minus 400 mesh TSS, and then it was conditioned by adding to it an amount of $H_2SO_3$ in solution equivalent to adding 1.0 pound of $SO_2$ per ton of dry ore fed. The resultant pulp, which had a density of 14% solids by weight, was agitated for 3 minutes. It was then subjected to a first copper cleaner flotation stage using, per ton of dry ore fed, 0.005 pounds of Reagent R-208 (collector) and no additional frother. Flotation lasted for 10 minutes at a pH of 5.2. The resultant cleaner concentrate was itself subjected to a second copper cleaner flotation stage, for which 0.011 pound of MIBC (frother) per ton of dry ore fed and no additional collector were added. Flotation lasted for 10 minutes, at a pH of 5.5. The concentrate from this stage was fed to a third copper cleaner flotation stage, with no additional reagents. Flotation lasted for 8 minutes, at a pH of 5.6. Underflows from the first and second cleaner stages were recycled to the first conditioning stage, and the underflow from the third copper cleaner was recycled to the second conditioning stage.

The copper and nickel contents and recoveries in the concentrates from the copper cleaner flotation stages are given in Table 1.

Table 2 shows the solids content, and copper and nickel recovery data, for the underflow stream from the copper rougher flotation. 2.11 pounds of lime and 0.27 pounds of $CuSO_4$, per ton of dry ore fed, were added to the underflow stream to activate the nickel and residual copper, raising the pH of the stream to 8.6. The stream, containing these conditioners, was agitated for about 3 minutes. Then 0.030 pound of sodium isopropyl xanthate (collector) and 0.104 pound of a MIBC-cresylic acid mixture (frother) (each, per ton of dry ore fed) were added to the conditioned stream, and the stream was subjected to copper-nickel rougher flotation for about 30 minutes. The solids content, nickel content and recovery, and copper content and recovery, of the nickel rougher concentrate are shown in Table 2. The copper-nickel rougher concentrate was reground to about 86 wt.% minus 400 mesh TSS, and then subjected to three stages of cleaner flotation. Underflows from the first and second cleaner stages were recycled to the Cu-Ni rougher.

The solids content, copper and nickel contents, and copper and nickel recoveries from the copper-nickel cleaning circuit are given in Table 2.

EXAMPLE 6

Ore assaying 0.51% Cu and 0.11% Ni was ground to 57.2% minus 200 mesh TSS. The ground ore was slurried with water to 35% solids by weight. An aqueous solution of 2.2 wt.% $H_2SO_3$ was prepared by dissolving sulfur dioxide in water, and this solution was added to the slurried ore to form a pulp having a ratio of acid to ore equivalent to 3.47 pounds of sulfur dioxide per ton of ore. The pulp density was 34 wt.% solids. The pH was 5.9. The pulp was agitated for about 8 minutes.

The conditioned pulp was prepared for the copper rougher flotation by adding to it, per ton of dry ore fed, 0.012 pounds of American Cyanamid Co. Reagent R-208 (collector) and 0.047 pounds of MIBC (frother). The circuit was using continuously recycled water containing some reagents. This mixture was subjected to copper rougher flotation for 14 minutes. A froth was obtained containing 12.1 wt.% solids, and an underflow stream was obtained containing 87.9 wt.% solids. The grades and recoveries of copper and nickel in the two product streams are given below in Table 1.

The copper rougher concentrate was classified and reground so that 88% was minus 400 mesh TSS, and then it was conditioned by adding to it an amount of $H_2SO_3$ in solution equivalent to adding 0.99 pound of $SO_2$ per ton of dry ore fed. The resultant pulp, which had a density of 15% solids by weight, was agitated for 10 minutes. It was then subjected to a first copper cleaner flotation stage, using no additional collector and 0.012 pounds of MIBC (frother) per ton of dry ore fed. Flotation lasted for 11 minutes at a pH of 5.6. The resultant cleaner concentrate was itself subjected to a second copper cleaner floatation stage, for which no additional collector and 0.006 pounds of MIBC (frother) per ton of dry ore fed were added. Flotation lasted for 10 minutes, at a pH of 5.7. The concentrate from this stage was fed to a third copper cleaner flotation stage, with no additional reagents. Flotation lasted for 9 minutes, at a pH of 6.0. Underflows from the first and second cleaner stages were recycled to the first conditioning stage, and the underflow from the third copper cleaner was recycled to the second conditioning stage.

The copper and nickel contents and recoveries in the concentrate from the copper cleaner flotation stages are given in Table 1.

Table 2 shows the solids content, and copper and nickel recovery data, for the underflow stream from the copper rougher flotation. The stream was conditioned with lime, and subjected to copper-nickel rougher flotation under conditions similar to those of Example 5. The resulting rougher concentrate was reground and upgraded by cleaner flotation in the manner described in Example 5 but employing four flotation stages. The solids content, copper and nickel contents, and copper and nickel recoveries from the copper-nickel cleaning circuit are given in Table 2.

EXAMPLE 7

Ore assaying 0.50% Cu and 0.11% Ni was ground to 56.4% minus 200 mesh TSS. The ground ore was slurried with water to 32% solids by weight. An aqueous solution of 2.2wt.% $H_2SO_3$ was prepared by dissolving sulfur dioxide in water, and this solution was added to the slurried ore to form a pulp having a ratio of acid to ore equivalent to 3.5 pounds of sulfur dioxide per ton of ore. The pulp density was 32 wt.% solids. The pH was 6.2. The pulp was agitated for about 6 minutes.

The conditioned pulp was prepared for the copper rougher flotation by adding to it, per ton of dry ore fed, 0.052 pound of American Cyanamid Co. Reagent R-208 (collector) and 0.088 pound of MIBC (frother). This mixture was subjected to copper rougher flotation for 15 minutes. A froth was obtained containing 10.8 wt.% solids, and an underflow stream was obtained containing 89.2 wt.% solids. The grades and recoveries of copper and nickel in the two product streams are given below in Table 1.

The copper rougher concentrate was classified and reground so that 91.2% was minus 400 mesh TSS, and then it was conditioned by adding to it an amount of $H_2SO_3$ in solution equivalent to adding 1. pound of $SO_2$ per ton of dry ore fed. The resultant pulp, which had a density of 16% solids by weight, was agitated for 10 minutes. It was then subjected to a first copper cleaner flotation stage, using no additional collector and 0.022 pound of MIBC (frother) per ton of dry ore fed. Flotation lasted for 10 minutes at a pH of 5.7. The resultant cleaner concentrate was itself subjected to a second copper cleaner flotation stage, for which no additional collector and 0.018 pound of MIBC (frother) per ton of dry ore fed were added. Flotation lasted for 10 minutes, at a pH of 6.0. The concentrate from this stage was fed to a third copper cleaner flotation stage, with no additional reagents added. Flotation lasted for 9 minutes, at a pH of 6.4. Underflows from the first and second cleaner stages were recycled to the first conditioning stage, and the underflow from the third cleaner was recycled to the second conditioning stage.

The copper and nickel contents and recoveries in the concentrate from the copper cleaner flotation stages are given in Table 1.

Table 2 shows the solids content, and copper and nickel recovery data, for the underflow stream from the copper rougher flotation. This stream was conditioned with lime, and subjected to copper-nickel rougher flotation under conditions similar to thoseof Example 5. The resulting rougher concentrate was reground and upgraded by cleaner flotation in the manner described in Example 5 but employing four flotation stages. The solids content, copper and nickel contents, and copper and nickel recoveries from the copper-nickel cleaning circuit are given in Table 2.

EXAMPLE 8

Ore assaying 2.89% Cu and 0.53% Ni was ground to 63.1% minus 200 mesh TSS. The ground ore was slurried with water to 29% solids by weight. An aqueous solution of 2.2 wt.% $H_2SO_3$ was prepared continuously by dissolving sulfur dioxide in water, and this solution was added to the slurried ore to form a pulp having a ratio of acid to ore equivalent to 2.5 pounds of sulfur dioxide per ton of dry ore. The pH was 5.9. The pulp was agitated for about 8 minutes.

The conditioned pulp was prepared for the copper rougher flotation by adding to it, per ton of dry ore fed, 0.087 pound of American Cyanamid Co. Reagent R-208 (collector) and 0.095 pound of MIBC (frother). This mixture was subjected to copper rougher flotation for 14 minutes. A froth was obtained containing 22.75 wt.% solids, and an underflow stream was obtained containing 77.25 wt.% solids. The grades and recoveries of copper and nickel in the two product streams are given below in Table 1.

The copper rougher concentrate was classified and reground so that 52% was minus 400 mesh TSS, and then it was conditioned by adding to it an amount of $H_2SO_3$ in solution equivalent to adding 1 pound of $SO_2$ per ton of dry ore fed. The resultant pulp, which had a density of 10.5% solids by weight, was agitated for 3 minutes. It was then subjected to a first copper cleaner flotation stage using no additional collector and 0.045 pounds of MIBC (frother) per ton of dry ore fed. Flotation lasted for 10 minutes at a pH of 5.9. The resultant cleaner concentrate was itself subjected to second and third copper cleaner flotation stages, for which 0.014 pound of American Cyanamid Co. Reagent R-208 (collector) and 0.065 pound of MIBC (frother) were required per ton of dry ore fed in each cleaner stage. Second cleaner flotation lasted for 10 minutes, at a pH of 5.9. Third cleaner flotation lasted for 8 minutes, at a pH of 6.0. Underflows from the first and second copper cleaner stages were recycled to the first conditioning stage, and the underflow from the third cleaner stage was recycled to the second conditioning stage.

The copper and nickel contents and recoveries in the concentrate from the copper cleaner flotation stages are given in Table 1.

Table 2 shows the solids content, and copper and nickel recovery data, for the underflow stream from the copper rougher flotation. 3.23 pounds of lime per ton of dry ore fed was added to the underflow stream to activate the nickel and residual copper, raising the pH of the stream to 8.6. The stream containing the conditioner was agitated for about 3 minutes. Then 0.10 pound of sodium isopropyl xanthate (collector) and 0.10 pound of MIBC (frother), each per ton of dry ore fed, were added to the conditioned stream and the pulp was subjected to copper-nickel rougher flotation, followed by three stages of cleaning. The solids content, and copper and nickel contents and recoveries, from the copper-nickel cleaning circuit are given in Table 2.

TABLE 1

| | Example No. | | | | |
|---|---|---|---|---|---|
| | 4 | 5 | 6 | 7 | 8 |
| Feed grade, % Cu | 0.91 | 0.82 | 0.51 | 0.50 | 2.89 |
| % Ni | 0.20 | 0.18 | 0.11 | 0.11 | 0.53 |
| Cu Rougher conc. | | | | | |
| solids, % of circuit feed | 10.8 | 8.5 | 12.1 | 10.8 | 22.75 |
| grade, % Cu | 7.78 | 8.93 | 8.63 | 7.17 | 12.5 |
| % Ni | 0.72 | 1.00 | 0.70 | 0.42 | 0.75 |
| First Cu cleaner con. | | | | | |
| grade, % Cu | 15.4 | 14.1 | 13.9 | 13.4 | 16.1 |
| % Ni | 0.88 | 0.68 | 0.48 | 0.38 | 0.59 |
| Second Cu cleaner con. | | | | | |
| solids, % of circuit feed | 4.6 | — | — | — | — |
| grade, % Cu | 16.4 | 15.4 | 17.1 | 16.8 | 16.9 |
| % Ni | 0.86 | 0.40 | 0.42 | 0.34 | 0.34 |
| Third Cu cleaner con. | | | | | |
| solids, % of circuit feed | 4.1 | 3.36 | 1.87 | 1.86 | 12.1 |
| grade, % Cu | 17.7 | 19.2 | 22.7 | 20.6 | 19.9 |
| % Ni | 0.80 | 0.27 | 0.23 | 0.22 | 0.23 |
| recovery, % Cu | 80.0 | 88.4 | 83.3 | 76.6 | 83.6 |
| % Ni | 16.8 | 5.2 | 3.9 | 3.7 | 5.7 |

TABLE 2

| | Example No. | | | | |
|---|---|---|---|---|---|
| | 4 | 5 | 6 | 7 | 8 |
| Cu rougher underflow | | | | | |
| solids, % of circuit feed | 89.2 | 96.6 | 98.2 | 98.1 | 87.9 |
| grade, % Cu | 0.076 | 0.088 | 0.093 | 0.12 | 0.72 |
| % Ni | 0.13 | 0.17 | 0.11 | 0.11 | 0.66 |
| recovery, % Cu | 7.4 | 11.6 | 18.1 | 23.4 | 16.4 |
| % Ni | 59.8 | 94.8 | 96.2 | 96.3 | 94.3 |
| Cu—Ni rougher con. | | | | | |
| solids, % of circuit feed | — | 4.17 | 9.34 | 10.1 | 27.7 |
| grade, % Cu | — | 1.61 | 1.51 | 1.49 | 2.69 |
| % Ni | — | 3.59 | 1.48 | 1.41 | 2.51 |
| First Cu—Ni cleaner con. | | | | | |
| grade, % Cu | — | 2.90 | 2.85 | 3.32 | 5.71 |
| % Ni | — | 6.75 | 3.11 | 3.00 | 4.87 |
| Second Cu—Ni cleaner con. | | | | | |
| grade, % Cu | — | 3.49 | 2.90 | 4.57 | 6.29 |
| % Ni | — | 9.75 | 3.78 | 4.34 | 5.47 |
| Third Cu—Ni cleaner con. | | | | | |
| solids, % of circuit feed | 2.0 | 1.14 | — | — | — |
| grade, % Cu | 6.29 | 3.78 | 3.05 | 4.60 | 6.88 |
| % Ni | 4.56 | 10.3 | 4.14 | 4.66 | 5.96 |
| recovery, % Cu | 14.0 | 5.9 | — | — | 13.0 |
| % Ni | 43.6 | 67.0 | — | — | 68.9 |
| Fourth Cu—Ni cleaner con. | | | | | |
| solids, % of circuit feed | — | — | 1.72 | 1.62 | — |
| grade, % Cu | — | — | 3.15 | 5.42 | — |
| % Ni | — | — | 4.81 | 5.03 | — |
| recovery, % Cu | — | — | 10.8 | 17.5 | — |
| % Ni | — | — | 69.6 | 68.7 | — |

It will be recognized that the copper grade of the cleaner concentrates may depend on, among other factors, the copper grade of the feed material. The copper grade of the feed material, in turn, depends on the relative proportions of chalcopyrite and cubanite in the feed material, since a given quantity of chalcopyrite contains more copper than the same quantity of cubanite. We have found, though, that the copper concentrate grade is relatively independent of the feed grade in our process. The recovery data given herein are, moreover, obtainable over a wide range of copper grades in the feed material.

We claim:

1. A process for selectively recovering a copper concentrate and a nickel concentrate from finely ground feed ore which contains sulfide minerals of copper and nickel and which is substantially free from carbonate minerals, comprising pulping the ore with water to provide a slurry, adding sulfurous acid to the slurry in an amount equivalent to between about 2 pounds and about 4.5 pounds of sulfur dioxide per ton of said finely ground feed ore, wherein the slurry after addition of the sulfurous acid has a solids content between about 25% and about 35% by weight, conditioning the slurry with the sulfurous acid sufficiently long to allow the copper sulfide minerals to be floated selectively from the nickel sulfide minerals, adding a collector and a frother to the conditioned slurry, subjecting the conditioned slurry to froth flotation to produce a froth containing a copper rougher concentrate and an underflow copper rougher tailing, conditioning the copper rougher tailing to activate unfloated copper and nickel minerals, adding additional frother and collector to the copper rougher tailing, and then subjecting the copper rougher tailing to froth flotation to produce a froth containing a copper-nickel rougher concentrate.

2. The process of claim 1 wherein said finely ground feed ore is from the Duluth Complex ore body.

3. The process of claim 2 wherein said slurry is conditioned with sulfurous acid for between about 5 and about 10 minutes.

4. The process of claim 1 wherein said slurry is conditioned with sulfurous acid for between about 5 and about 10 minutes.

5. The process of claim 1, 2, 3 or 4 wherein said copper rougher concentrate contains at least about 80% of the copper, and less than about 40% of the nickel, contained in said finely ground feed ore.

6. The process of claim 1, 2, 3 or 4 wherein said copper-nickel rougher concentrate contains at least about 65% of the nickel, and less than about 20% of the copper, contained in said finely ground feed ore.

7. The process of claim 1, 2, 3 or 4 wherein said copper rougher concentrate contains at least about 80% of the copper and less than about 40% of the nickel contained in said finely ground feed ore, and wherein said copper-nickel rougher concentrate contains at least about 65% of the nickel and less than about 20% of the copper contained in said finely ground feed ore.

8. The process of claim 1, 2, 3 or 4 further comprising grinding the copper rougher concentrate such that at least about 85% is minus 400 mesh TSS, conditioning said ground copper rougher concentrate in aqueous sulfurous acid at a ratio equivalent to about 1 pound of sulfur dioxide per ton of finely ground feed ore sufficiently long to maximize depression of the nickel sulfide minerals while maximizing activation of the copper sulfide minerals, and subjecting the conditioned copper rougher concentrate to a plurality of froth flotation cleaning stages to recover a copper cleaner concentrate.

9. The process according to claim 8 wherein said copper cleaner concentrate contains at least about 75% of the copper, and less than about 5% of the nickel, contained in said finely ground feed ore.

10. The process according to claim 9 further comprising subjecting the copper-nickel rougher concentrate to a plurality of froth flotation nickel cleaning stages, to recover a copper-nickel cleaner concentrate containing at least about 60% of the nickel, and less than about 20% of the copper, contained in said finely ground feed ore.

11. The process of claim 1 wherein the pH of the conditioned slurry is between about 5 and about 6.5.

12. A process for selectively recovering a copper concentrate and a nickel concentrate from finely ground feed ore which contains sulfide minerals of copper and nickel and which is substantially free from carbonate minerals, comprising pulping the ore with water to provide a slurry, adding to the slurry a conditioning agent consisting essentially of sulfurous acid in an amount equivalent to between about 2 pounds and about 4.5 pounds of sulfur dioxide per ton of said finely ground feed ore, wherein the slurry after addition of the sulfurous acid has a solids content between about 25% and about 35% by weight, conditioning the slurry with the sulfurous acid sufficiently long to allow the copper sulfide minerals to be floated from the nickel sulfide minerals, adding a collector and a frother to the conditioned slurry, subjecting the conditioned slurry to froth flotation to produce a frother containing a copper rougher concentrate and an underflow copper rougher tailing, conditioning the copper rougher tailing to activate unfloated copper and nickel minerals, adding additional frother and collector to the copper rougher tailing, and then subjecting the copper rougher tailing to froth flotation to produce a froth containing a copper-nickel rougher concentrate.

* * * * *